US008391756B2

(12) United States Patent
Yasumoto

(10) Patent No.: US 8,391,756 B2
(45) Date of Patent: Mar. 5, 2013

(54) IMAGE FORMING APPARATUS HAVING PLURALITY OF IMAGE TRANSFER UNITS WITH STABLE IMAGE TRANSFERS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/778,848

(22) Filed: May 12, 2010

(65) Prior Publication Data

US 2010/0310285 A1 Dec. 9, 2010

(30) Foreign Application Priority Data

Jun. 5, 2009 (JP) ..... 2009-136364

(51) Int. Cl.
*G03G 15/01* (2006.01)

(52) U.S. Cl. ..... 399/299; 399/302

(58) Field of Classification Search ..... 399/299, 399/302, 394

See application file for complete search history.

(56) References Cited

U.S. PATENT DOCUMENTS

| | | | | |
|---|---|---|---|---|
| 5,087,945 | A * | 2/1992 | Randall | 399/299 |
| 5,870,659 | A * | 2/1999 | Maruyama et al. | 399/299 |
| 2003/0108366 | A1 * | 6/2003 | Yamada et al. | 399/299 |
| 2004/0131395 | A1 * | 7/2004 | Ishida | 399/302 |
| 2008/0075487 | A1 * | 3/2008 | Furushige | |

FOREIGN PATENT DOCUMENTS

| | | | |
|---|---|---|---|
| JP | 08133528 | A * | 5/1996 |
| JP | 2006-301332 | | 11/2006 |

* cited by examiner

*Primary Examiner* — David Gray
*Assistant Examiner* — Laura Roth
(74) *Attorney, Agent, or Firm* — Canon USA Inc IP Division

(57) ABSTRACT

In an image forming apparatus using an intermediate transfer tandem method, image forming unit is divided into two parts and toner images superimposed on an intermediate transfer belt included in one of the image forming unit is once secondary transferred onto toner images superimposed on an intermediate transfer belt included in the other image forming unit. Then the secondary transferred images are collectively transferred (tertiary transferred) onto a recording material at once.

5 Claims, 10 Drawing Sheets

$\beta < 90°$ $\beta > 90°$ $\beta = 90°$

S01
START
S02
INPUT IMAGE FORMING SIGNAL
S03
START PAPER FEEDING OPERATION
S04
IS PAPER SUCCESSFULLY FED ?
NO
YES
S11
CAN PAPER BE FED AGAIN ?
YES
NO
S12
JAM
S05
GENERATE IMAGE FORMING START SIGNAL
S06
IS FULL COLOR IMAGE FORMED ?
NO
YES
S07
START FORMING IMAGE Y
S08
START FORMING IMAGE M
S09
START FORMING IMAGE C
S10
START FORMING IMAGE Bk
END

IMAGE FORMING APPARATUS HAVING PLURALITY OF IMAGE TRANSFER UNITS WITH STABLE IMAGE TRANSFERS

BACKGROUND OF THE INVENTION

1. Field of the Invention

The present invention relates to a full color image forming apparatus (such as a copying machine, and a printer, for example) with a plurality of photosensitive members.

2. Description of the Related Art

In recent years, a configuration in which image forming units for each color are arranged on intermediate transfer members as illustrated in FIG. 9 (hereinafter referred to as an intermediate transfer tandem method) has been used according as a full color image forming apparatus using an electrophotographic method has been increased in speed and materials have been diversified. Cylindrical intermediate transfer drums and an intermediate transfer belt stretched between a plurality of rollers are used as the intermediate transfer member. FIG. 9 illustrates the configuration using the latter being high in the degree of freedom of a stretching layout.

An image forming apparatus 60 illustrated in FIG. 9 is configured such that a full-color toner image formed on an intermediate transfer belt 605 is transferred on a recording material S conveyed from a recoding material storage unit 62 at a transfer unit formed of a secondary transfer inner roller 608 and a secondary transfer outer roller 66. The full-color toner image is formed in order from a yellow (hereinafter referred to as Y) image forming unit positioned in the most upstream side with respect to a direction indicated by an arrow B. In other words, an image forming process for magenta, cyan, and black (hereinafter referred to as M, C, and Bk respectively) is sequentially started at predetermined timing intervals. The toner images M, C, Bk are superposed on the toner image Y on the intermediate transfer belt 605. The toner image Y located in the most upstream position is taken as an example to describe a basic image forming process. The photosensitive member 611Y which serves as an image carrier and rotates in a direction indicated by an arrow D is uniformly charged by a primary charging device 612Y. An electrostatic latent image is formed by image exposure of an exposure apparatus 609Y based on image information previously formed on the charged photosensitive member 611Y. Light from the exposure apparatus 609Y reaches an exposure position on the photosensitive member 611Y through a diffractive member 610Y. The electrostatic latent image is visualized as a toner image by a development device 613Y and electrostatically transferred onto the intermediate transfer belt 605 by a primary transfer roller 618Y as described above. The similar processing is executed in other image forming units.

Thus, a plurality of the image forming units is arranged side by side to increase a distance of movement of an image. In other words, a substantial distance of movement of an image is equal to the sum of a perimeter (in the direction D) of the photosensitive member 611Y from the exposure position in the image forming unit Y located in the most upstream position to a nip portion of the primary transfer roller 618Y and a perimeter (in the direction B) of the intermediate transfer belt 605 from the nip portion of the primary transfer roller 618Y to the secondary transfer unit. Such a long distance of movement of an image is relatively apt to exceed a distance of movement of the recording material S (i.e., a conveyance distance between a paper feeding apparatus 63 and the secondary transfer unit).

When the distance of movement of an image is longer than the distance of movement of the recording material to the secondary transfer unit, the timing at which an image is started to be formed needs to be earlier than the timing at which the recording material is started to be conveyed.

As a result, if any failure in paper feeding, such as a failure to pick up paper, occurs in the paper feeding apparatus 63, a complicated control is required to match the timing between the image and the paper in the control for starting feeding paper after starting forming an image. For this reason, the time, during which the image is started to be formed and then the toner image reaches the secondary transfer unit, is desirably shortened as much as possible.

Japanese Patent Application Laid-Open No. 2006-301332 discusses a configuration in which a plurality of secondary transfer units is provided to shorten the time during which an image is started to be formed and then a toner image reaches the secondary transfer unit. The configuration discussed in Japanese Patent Application Laid-Open No. 2006-301332 is provided with two intermediate transfer belts 73*a* and 73*b* for four photosensitive members 70*a* to 70*d* as illustrated in FIG. 10A. Further, there are provided two secondary transfer nips Ta and Tb in which a secondary transfer belt 74 is backed up by secondary transfer rollers 75 and 76. In this configuration, as illustrated in FIG. 10A, a first and a second color are transferred from the photosensitive members 70*b* and 70*a* onto the intermediate transfer belt 73*a* by primary transfer rollers 71*b* and 71*b*. On the other hand, a third and a fourth color are transferred from the photosensitive members 70*c* and 70*d* onto the intermediate transfer belt 73*b* by primary transfer rollers 72*c* and 72*d*. This produces an effect of shortening the distance of movement of an image.

As illustrated in FIG. 10B, the image forming unit is completely divided into two portions to allow obtaining an effect of further shortening the distance of movement of an image using an image process equivalent to the above described pattern in FIG. 10A. Thus, providing a plurality of secondary transfer units allows shortening the distance between the exposure position of the first color and the transfer unit where a toner image is transferred on a recording material. Accordingly, time during which an image is started to be formed and then a toner image reaches the secondary transfer unit can be shortened.

Japanese Patent Application Laid-Open No. 2006-301332, however, has the following problem because it needs a plurality of the secondary transfer units, i.e., multiple transfers onto the recording material. More specifically, the secondary transfer unit in a second time is affected by the toner image transferred by the secondary transfer unit in a first time to make the transfer condition strict.

For that reason, the number of times that a toner image is transferred on a recording material is desirably made as smaller as possible in forming a full-color image.

SUMMARY OF THE INVENTION

The present invention is directed to improvement of a transfer stability by collectively transferring a full-color toner image onto a recording material even though a plurality of intermediate transfer members is provided.

According to an aspect of the present invention, an image forming apparatus includes a first image forming unit which includes a first image carrier and is configured to form a toner image on the first image carrier, a first intermediate transfer member configured to carry the toner image primarily transferred from the first image carrier, a second image forming unit which includes a second image carrier and is configured to form a toner image on the second image carrier, a second intermediate transfer member configured to carry the toner image primarily transferred from the second image carrier, an execution unit configured to execute an operation to cause the second image forming unit to form an image while the first image forming unit is forming an image, a secondary transfer unit configured to transfer the toner image from the first intermediate transfer member to the second intermediate transfer member such that the toner image formed on the first intermediate transfer member is superposed on the toner image formed on the second intermediate transfer member, and a tertiary transfer unit configured to transfer the toner image formed on the second intermediate transfer member by the secondary transfer unit onto a recording material from the second intermediate transfer member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus according to a first exemplary embodiment is described below with reference to FIG. 1. The image forming apparatus according to the present exemplary embodiment includes image forming units for yellow (Y), magenta (M), cyan (C), and black (Bk). The image forming apparatus includes a first process unit formed of a first image forming unit and an intermediate transfer belt (a first belt member) serving as a first intermediate transfer member. The image forming apparatus is configured such that a second process unit including the first, the second, and the third image forming units and an intermediate transfer belt (a second belt member) is separated from the first process unit.

Figure 1:
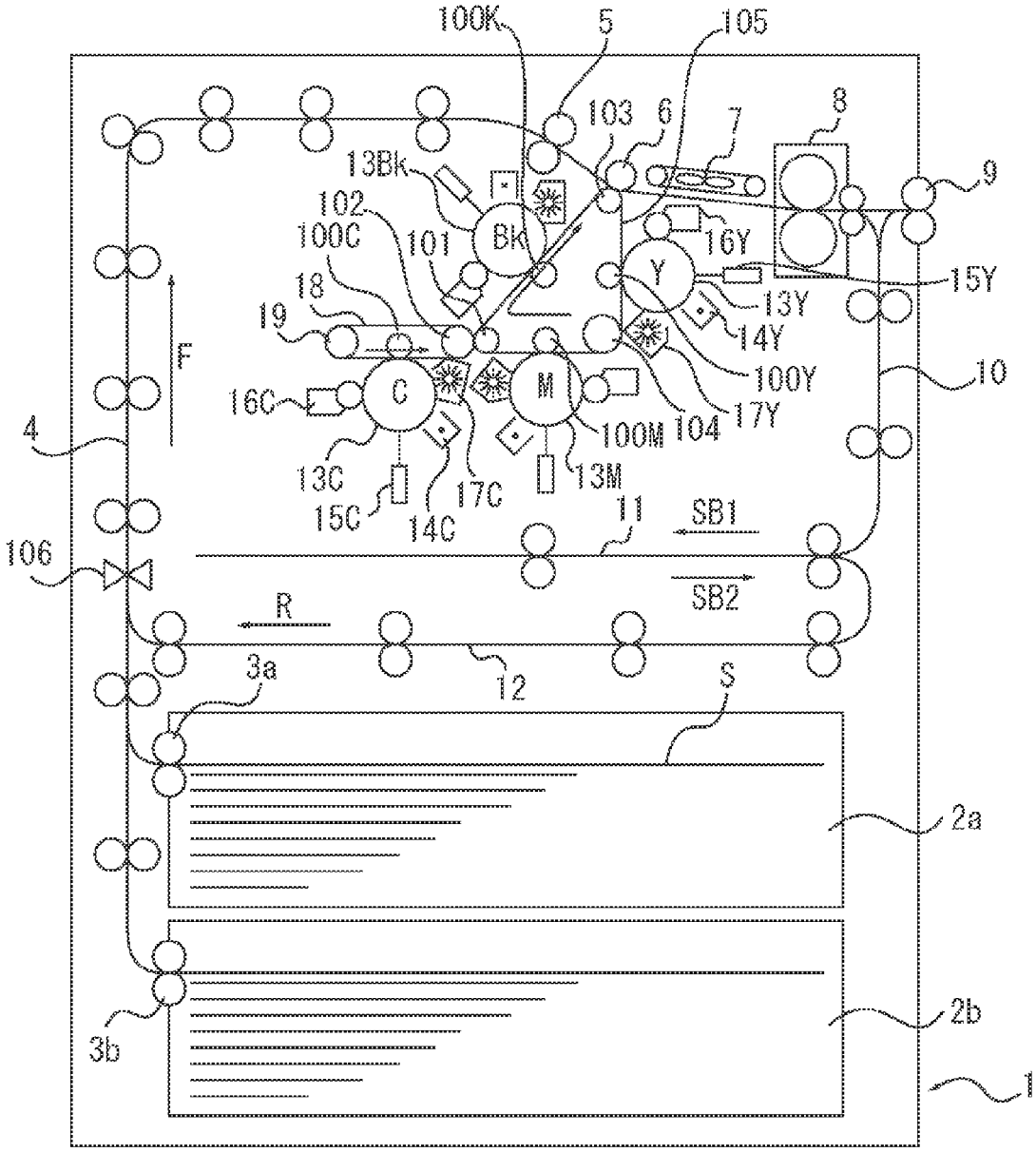
FIG. 1 is a cross sectional view of an image forming apparatus according to a first exemplary embodiment of the present invention.

FIG. 1 is a cross sectional view of the image forming apparatus according to the present exemplary embodiment. In the first process unit, only the image forming unit C for cyan (C) is arranged to face a first intermediate transfer belt 18.

The image forming process in the image forming unit C serving as the first image forming unit is such that a photosensitive member 13C serving as a first image carrier is uniformly charged by a primary charging device 14C and then an electrostatic latent image is formed by the image exposure of an exposure apparatus 15C. The electrostatic latent image is visualized as a toner image by a development device 16C and electrostatically transferred onto the first intermediate transfer belt 18 by a primary transfer roller 100C serving as a primary transfer member. A residual transfer toner left on the photosensitive member 13C is collected by a photosensitive member cleaner 17C. The first intermediate transfer belt 18 is stretched between a belt drive roller 19 and a stretch roller 102 and conveyed in a direction indicated by an arrow in the figure.

The present exemplary embodiment includes a first and a second stacking unit 2*a* and 2*b* serving as stacking units for stacking a recording material and a first and a second paper feed unit 3*a* and 3*b* serving as a paper feed unit for feeding the recording material from the stacking units.

On the other hand, in the second process unit, the image forming units Y, M, and Bk for yellow, magenta, and black respectively are arranged at a second intermediate transfer belt 105 serving as a second intermediate transfer member. In the present exemplary embodiment, the image forming unit Y serving as a second image forming unit includes a photosensitive member 13Y serving as a second image carrier. The image forming unit M serving as a third image forming unit includes a photosensitive member 13M serving as a third image carrier. The image forming unit Bk serving as a fourth image forming unit includes a photosensitive member 13Bk serving as a fourth image carrier. The image forming process in the image forming unit for each color is similar to the case of the image forming unit C described above. The second intermediate transfer belt 105 is stretched by a drive roller 104, a stretch roller 101, and a stretch roller 103 and rotated and moved in a direction indicated by an arrow in the figure. Although a method for stretching respective intermediate transfer belts is not limited to the method in FIG. 1, a method of stretch in FIG. 1 is taken as an example from the viewpoint of the minimum number of required stretch rollers and a space efficiency.

The image forming apparatus 1 illustrated in FIG. 1 includes a tertiary transfer unit formed of the stretch roller 103 and a tertiary transfer outer roller 6. Four colored toner images formed on the second intermediate transfer belt 105 are collectively transferred at the tertiary transfer unit onto the recording material S fed from the paper feed unit. For this reason, a distance from the exposure position of the photosensitive member 13Y to the tertiary transfer unit via a development device 16Y and the primary transfer roller 100Y along a perimeter of the photosensitive member 13Y and along the second intermediate transfer belt 105 in the direction indicated by the arrow in the figure is a maximum, so that the distance is a substantial distance of movement of an image.

The image forming apparatus according to the present exemplary embodiment has two configurations: one in which the image forming process in the image forming unit C is conducted in parallel with the image forming process in the image forming unit M; the other in which the image forming units for each color are arranged on each side of the second intermediate transfer belt 105 which is triangularly stretched. The configurations can make the image forming units compact and shorten the distance of movement of an image. In the present exemplary embodiment, the distance of movement of an image is shorter than a distance between the paper feed unit 3*a* and the tertiary transfer unit which is the shortest among other distances of conveyance of the recoding material S. The distance between the paper feed unit 3*a* and the tertiary transfer unit is the distance of movement of the recoding material S.

In the present exemplary embodiment, the maximum distance of movement of an image is shorter than a distance between the paper feed unit 3*b* and the tertiary transfer unit that is the longest distance between the paper feed unit and the tertiary transfer unit.

Figure 8:
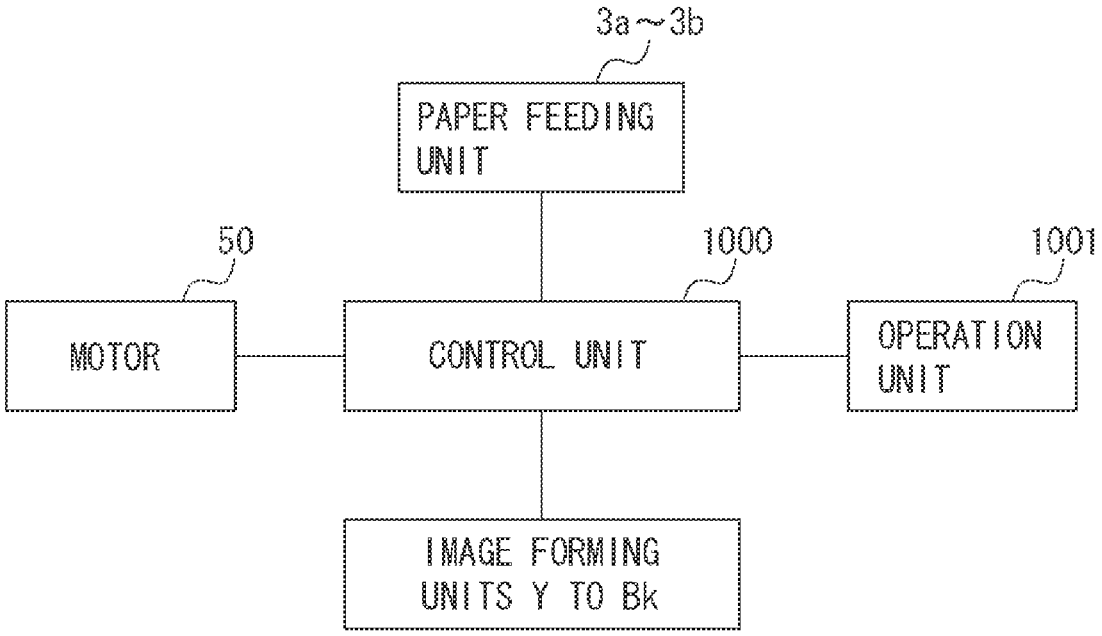
FIG. 8 is a block diagram illustrating the image forming apparatus according to the present exemplary embodiment.
Figure 9:
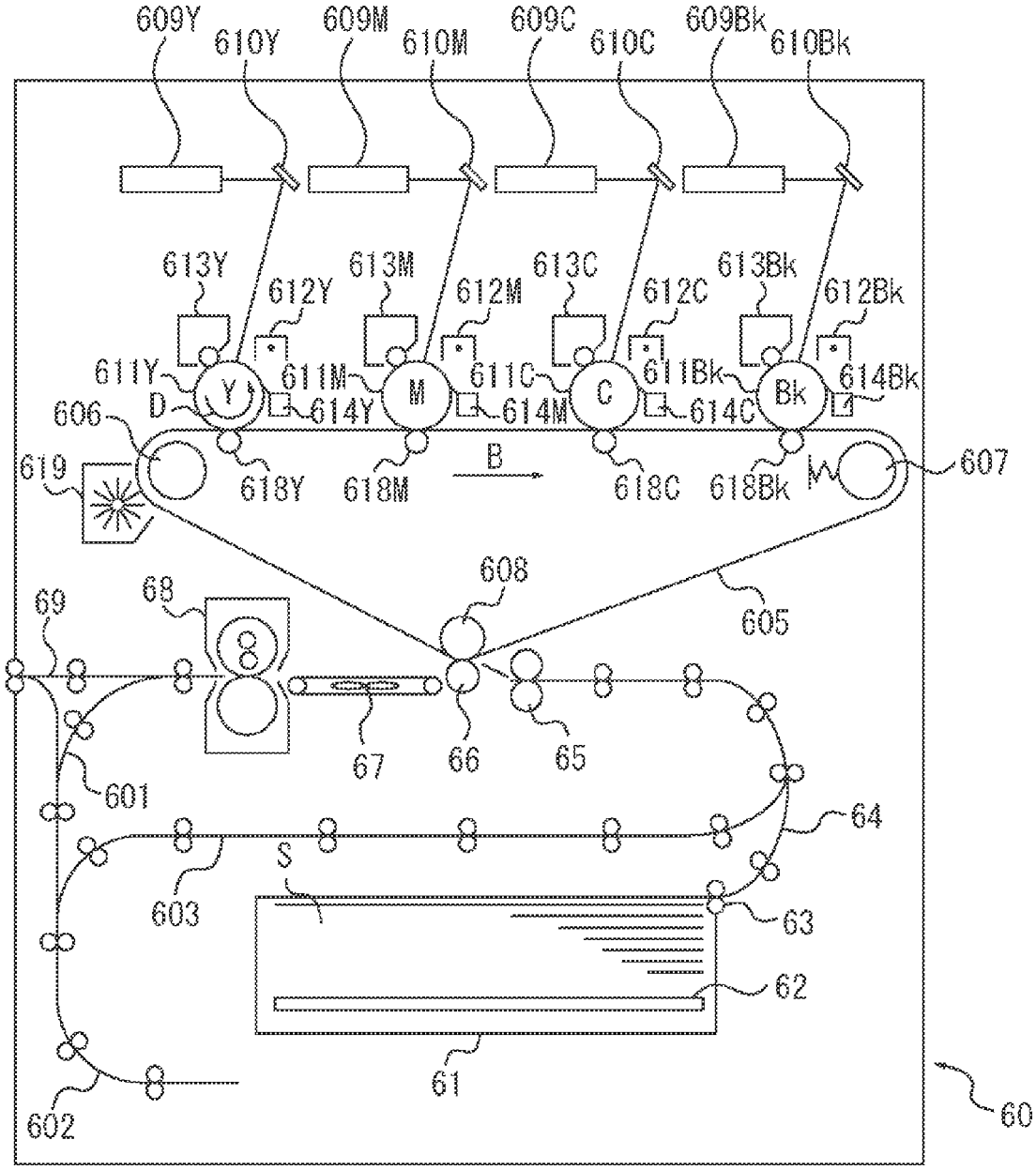
FIG. 9 is a cross sectional view illustrating an image forming apparatus using a conventional intermediate transfer tandem method.
Figure 10A:
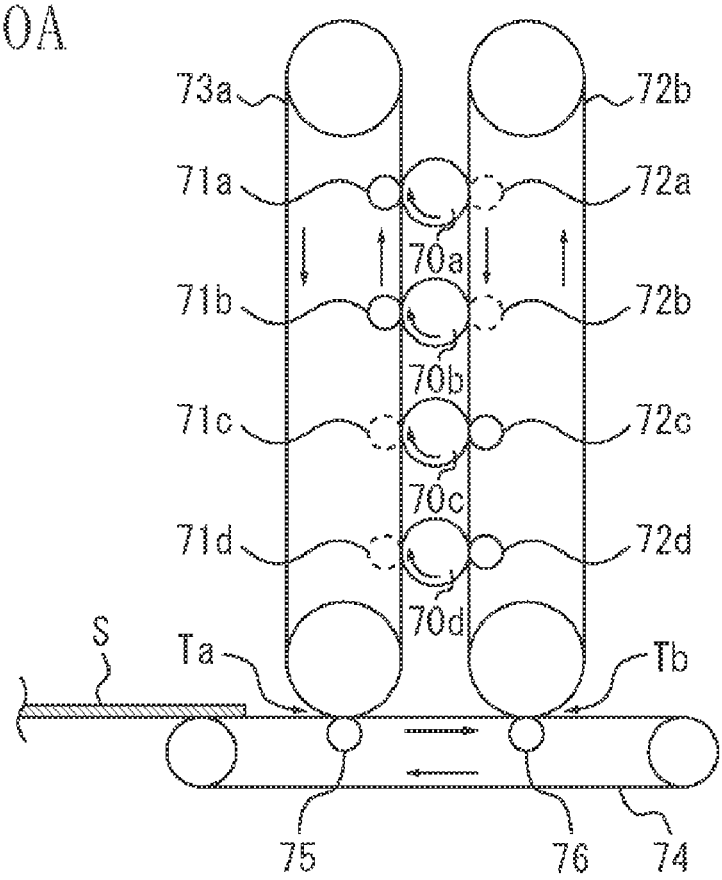
FIGS. 10A and 10B are cross sectional views illustrating a conventional image forming apparatus including a plurality of secondary transfer units.
Figure 10B:
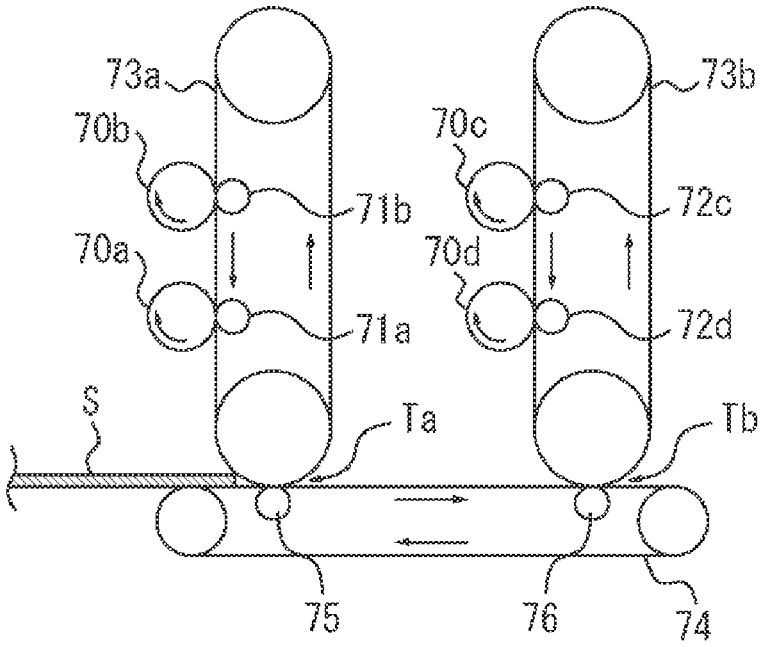

A block diagram of the present exemplary embodiment is described below with reference to FIG. 8. The present exemplary embodiment includes a control unit (central processing unit (CPU)) 1000 for controlling the image forming apparatus. The control unit 1000 controls, for example, the paper feed units 3*a* and 3*b* by transmitting a paper feed start signal thereto. The control unit 1000 controls the image forming units Y to Bk. The control unit 1000 includes an operation unit 1001 for allowing a user to operate to input an image forming signal to the image forming apparatus. A signal from the operation unit 1001 is input to the control unit 1000. The control unit 1000 further controls an operation of a motor 50 for driving the drive roller 104 for transmitting a drive force to the intermediate transfer belt.

Figure 6:
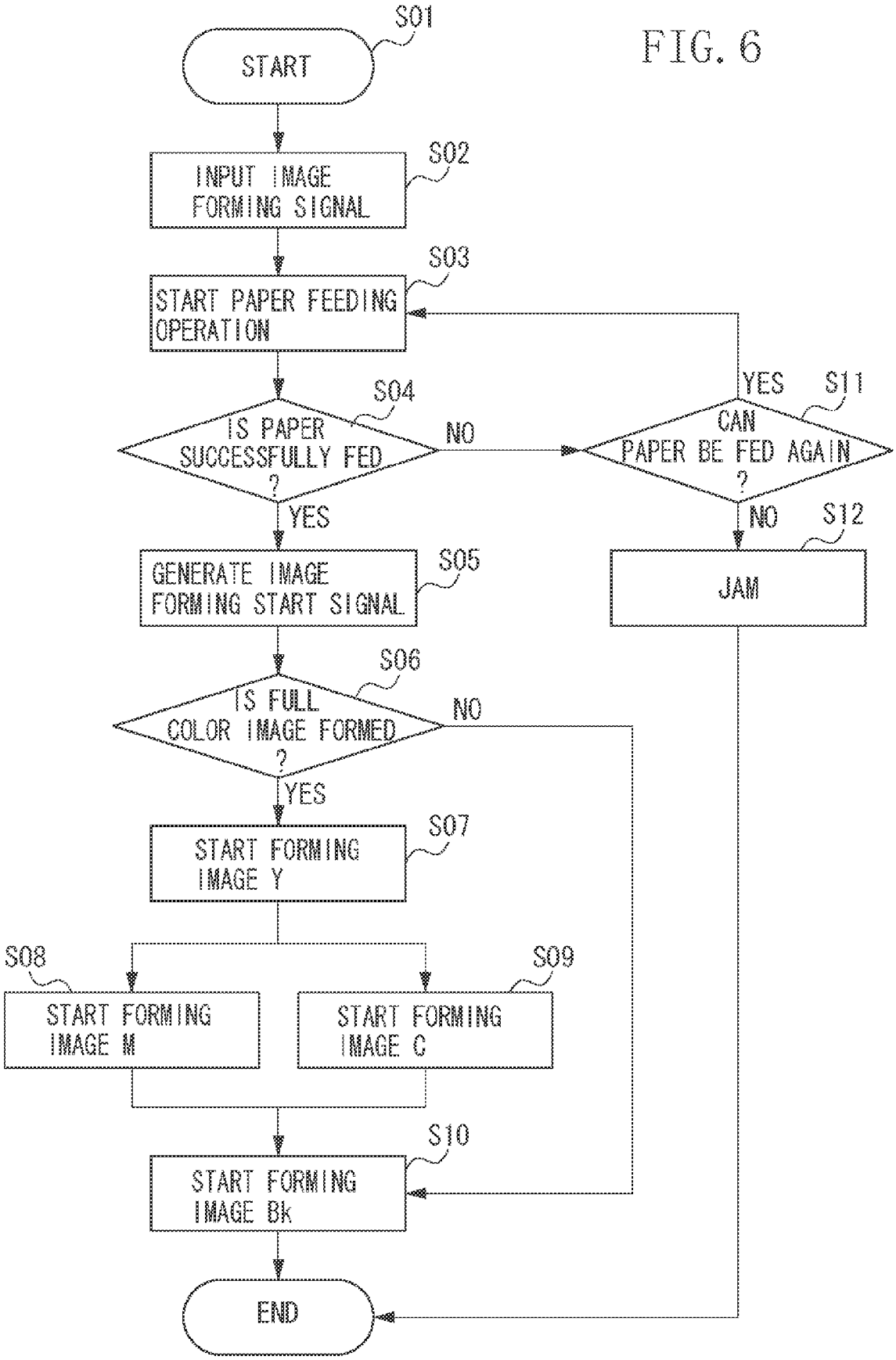
FIG. 6 is a flowchart illustrating an image formation according to the first exemplary embodiment of the present invention.

A relationship between a paper feeding operation and an image forming operation of the image forming apparatus 1 which has such a distance relationship is executed by a flow illustrated in FIG. 6. In step S01, an operational flow in FIG. 6 starts. In step S02, an image forming signal (print job) is input from the operation unit 1001 or the outside. In step S03, the paper feed units 3*a* or 3*b* starts an operation of feeding paper. In step S04, the control unit 1000 determines whether the paper is normally fed.

The control unit 1000 determines whether the recording material S conveyed in a direction indicated by an arrow F passes in a predetermined time interval using a detection sensor 106 provided on a main-body joining path 4, for example. If it is determined that the paper is normally fed (YES in step S04), then in step S05, the control unit 1000 generates an image forming start signal with a signal of the detection sensor 106 as a trigger. In step S06, the control unit 1000 determines whether the print job is to form a full-color image or a monochrome image (a black monochrome image in the present exemplary embodiment).

If the print job forms a full-color image (YES in step S06), in step S07, the image forming apparatus 1 first starts forming an image Y. The toner image Y is primarily transferred onto the second intermediate transfer belt 105 at the primary transfer unit 100Y and conveyed to the image forming unit M arranged downstream. In steps S08 and S09, at this point, the image forming at the image forming unit M is started in parallel with that at the image forming unit C.

In the present exemplary embodiment, the image forming units M and C simultaneously start forming images. More specifically, image exposure start signals (a first and a second image exposure start signal) are simultaneously transmitted to the photosensitive members 13C and 13M respectively. This is because a distance from a contact portion (the primary transfer unit) between the photosensitive member 13M and the second intermediate transfer belt 105 to the secondary transfer unit formed of the stretch rollers 101 and 102 is equal to a distance from a contact portion (the primary transfer unit) between the photosensitive member 13C and the first intermediate transfer belt 18 to the secondary transfer unit in the present exemplary embodiment.

This is also because a movement speed of the first intermediate transfer belt 18 is equal to that of the second intermediate transfer belt 105, so that the image formed by the image forming unit C is superposed on the image formed by the image forming unit M at the secondary transfer unit. In the present exemplary embodiment, the image forming units C and M simultaneously start forming images. However, if the respective distances from the primary transfer unit to the secondary transfer unit are different from each other or the respective movement speeds of the intermediate transfer belts are different from each other, the image forming timings can be made different according to the distances or the speeds.

The toner image formed by the image forming unit M is superposed on and primarily transferred onto the toner image formed by the image forming unit Y on the second intermediate transfer belt 105. Further, the toner image formed by the image forming unit C is primarily transferred onto the first intermediate transfer belt 18 and leading edges of both images meet at the secondary transfer unit at the timing at which the mutual leading edges coincide with each other. The secondary transfer unit applies electrostatic load bias to attractively move the cyan toner image on the first intermediate transfer belt 18 to the second intermediate transfer belt 105. In the present exemplary embodiment, since normal charge polarity of respective toners is negative, a predetermined positive-polarity voltage is applied to the stretch roller 101 and the stretch roller 102 is grounded, thereby enabling the secondary transfer.

The toner images Y, M, and C superposed on one another are conveyed to the image forming unit Bk. The toner images on the second intermediate transfer belt 105 are superposed in the order of Y, M, and C. In step S10, the image forming unit Bk starts forming an image in harmony with the timing at which the tree color toner images arrives and the primary transfer roller 100K forms a full-color toner image on the second intermediate transfer belt 105. Thereafter, the full-color toner image is electrostatically transferred at the tertiary transfer unit located more downstream than the secondary transfer unit onto the recording material S which is previously subjected to skew correction by a registration roller pair 5 and whose leading edge arrival timing is adjusted.

The recording material S on which an unfixed full-color toner image is collectively transferred by the above operational flow is conveyed to a fixing device 8 while being held by a suction conveyance belt 7 using the suction force of a fan. The fixing device 8 fixes the toner image on the recording material S using pressure force and heat of a heat source such as a heater. The recording material S passing the fixing device 8 is directly discharged to the outside of the apparatus by a discharge roller 9 or conveyed to a two-sided circulation path 10 if two-sided image forming is performed.

If the recording material S is conveyed to the two-sided circulation path 10, the recording material S is temporarily drawn into a switch-back reversing path 11 in a direction indicated by an arrow SB1 in the figure and then a conveyance roller is reversely rotated to convey the recording material S in a direction indicated by an arrow SB2 in the figure to a two-sided paper re-feeding path 12. The recording material S whose front and rear ends are thus reversed and which is led to the two-sided paper re-feeding path 12 is timed to the recording material of the succeeding job fed from the paper feed units 3*a* or 3*b* and joins again the main-body conveyance path 4 from a direction indicated by an arrow R in the figure. The two-sided image forming process is similar to the one-sided image forming process, so that the description thereof is omitted.

Returning to FIG. 6, if the detection sensor 106 determines that the paper is not normally fed (NO in step S04), in step S11, a re-trial operation can be performed if a paper re-feeding operation can be performed. For example, if a failure in feeding (for example, paper is not normally fed) results from slippage of the paper feed units 3*a* or 3*b*, the detection sensor 106 determines that the paper re-feeding operation can be performed (YES in step S11). Thus, in the operation flow in which an image is started to be formed with a paper-feed completion signal as a trigger, such an idea can be reflected that, even if it is unsuccessful in feeding paper, the unsuccessfulness is saved by the re-trial operation without simply being treated as jam if it is savable.

On the other hand, if the recording material S completely jams up the conveyance path, it is determined that the paper re-feeding operation cannot be performed (NO in step S11), then in step S12, the apparatus is stopped due to the jam.

An example of a full-color print job is described above. In the following, an example of a monochrome print job is described. As described in the operational flow in FIG. 6, if it is determined that the print job forms a monochrome image (NO in step S06), the processing proceeds to step S10 and the image Bk is directly started to be formed. In the cross sectional configuration of the image forming apparatus 1 illustrated in FIG. 1, the image forming unit Bk is arranged nearest to the tertiary transfer unit to allow the reduction of first copy output time in the monochrome print job.

In the image forming apparatus 1 illustrated in FIG. 1, the number of colors is taken as four and the colors Y, M, C, and Bk are arranged in this sequence. However, the number of colors and the arrangement sequence of the colors are not limited to the above configuration.

There is described below a second exemplary embodiment in which the image forming process for four different colors of Y, M, C, and Bk is divided into a first process unit including two different color image forming units and an intermediate transfer belt and a second process unit including two different color image forming units and an intermediate transfer belt.

Figure 2:
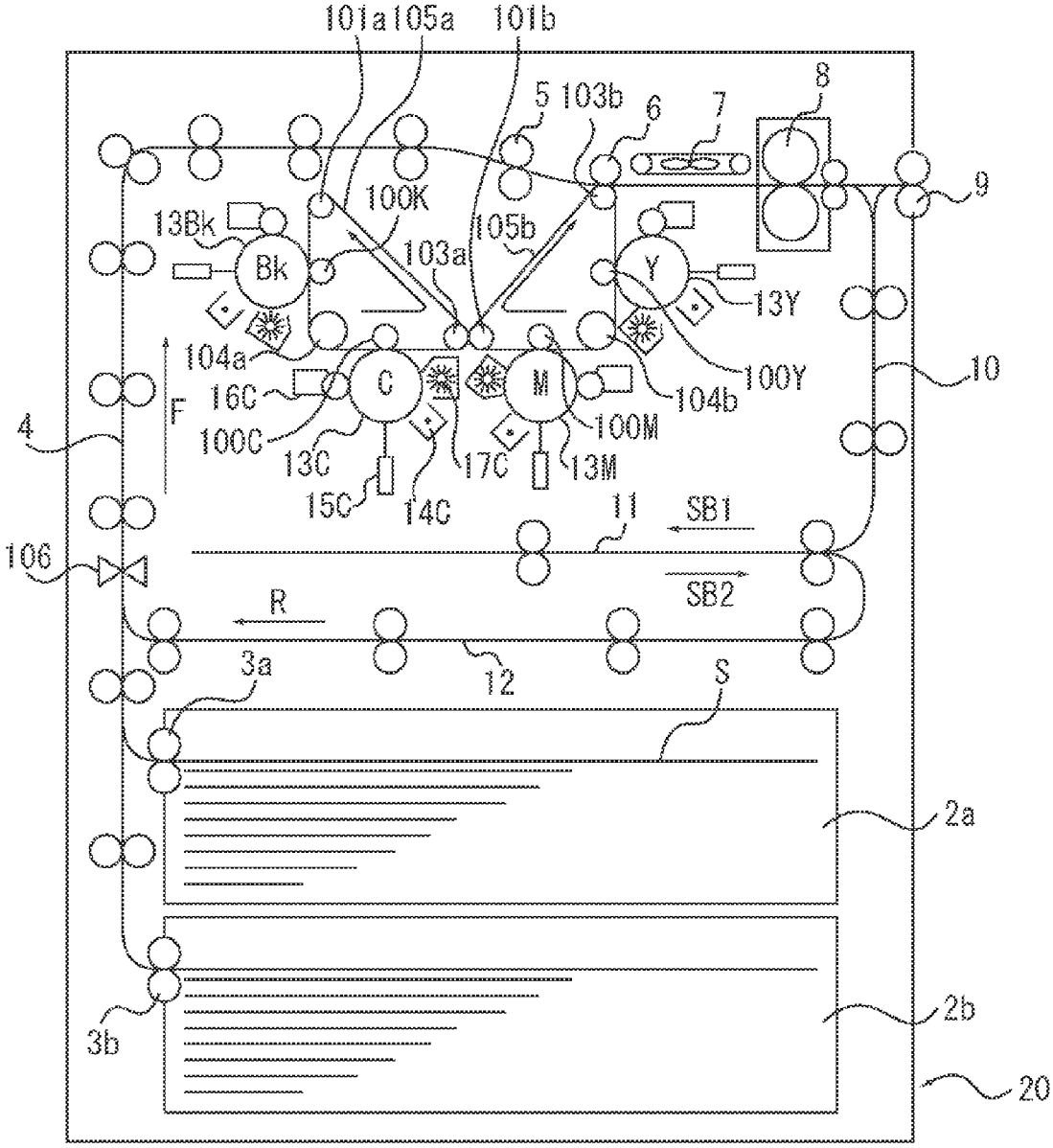
FIG. 2 is a cross sectional view of an image forming apparatus according to a second exemplary embodiment of the present invention.

FIG. 2 is a cross sectional view of an image forming apparatus according to the present exemplary embodiment. In the first process unit, the image forming units for black (Bk) and cyan (C) are arranged to face a first intermediate transfer belt 105*a*. The image forming process in the image forming unit for each color is similar to that described in the first exemplary embodiment, so that the description thereof is omitted.

The first intermediate transfer belt 105*a* is stretched among a belt drive roller 104*a* and stretch rollers 101*a* and 103*a* and conveyed in a direction indicated by an arrow in the figure. In the second process unit, the image forming units for yellow (Y) and magenta (M) are arranged to face a second intermediate transfer belt 105*b*. The image forming process in the image forming unit for each color is similar to that described in the first exemplary embodiment, so that the description thereof is omitted.

The second intermediate transfer belt 105*b* is stretched among a drive roller 104*b* and stretch rollers 101*b* and 103*b* and conveyed in a direction indicated by an arrow in the figure. In the present exemplary embodiment, the advantage of cost reduction due to the common use of components is taken into consideration, the first and the second intermediate transfer belts 105*a* and 105*b* are similar to each other in configuration and shape. The stretch configuration between the first and the second intermediate transfer belts 105*a* and 105*b* is not limited to that in FIG. 2.

In the image forming apparatus 20 illustrated in FIG. 2, four different color toner images are collectively transferred onto the recording material S at a tertiary transfer unit formed of the stretch roller 103*b* and a tertiary transfer outer roller 6. Therefore, both distances of movement of an image from the exposure position of the photosensitive members 13Y and 13Bk to the tertiary transfer unit are a maximum, so that the distances are a substantial distance of movement of an image. In the image forming apparatus 20, the image forming processes in the image forming units Y and Bk and the image forming units M and C are conducted in parallel. The image forming units for each color are arranged on each side of the first and the second intermediate transfer belts 105*a* and 105*b* each of which is triangularly stretched. The configuration can make the image forming units compact and shorten the distance of movement of an image. As a result, the distance of movement of an image is shorter than the distance between the paper feed unit 3*a* and the tertiary transfer unit which is the shortest among other distances of conveyance of the recoding material S. The distance between the paper feed unit 3*a* and the tertiary transfer unit is the distance of movement of the recoding material S.

Figure 7:
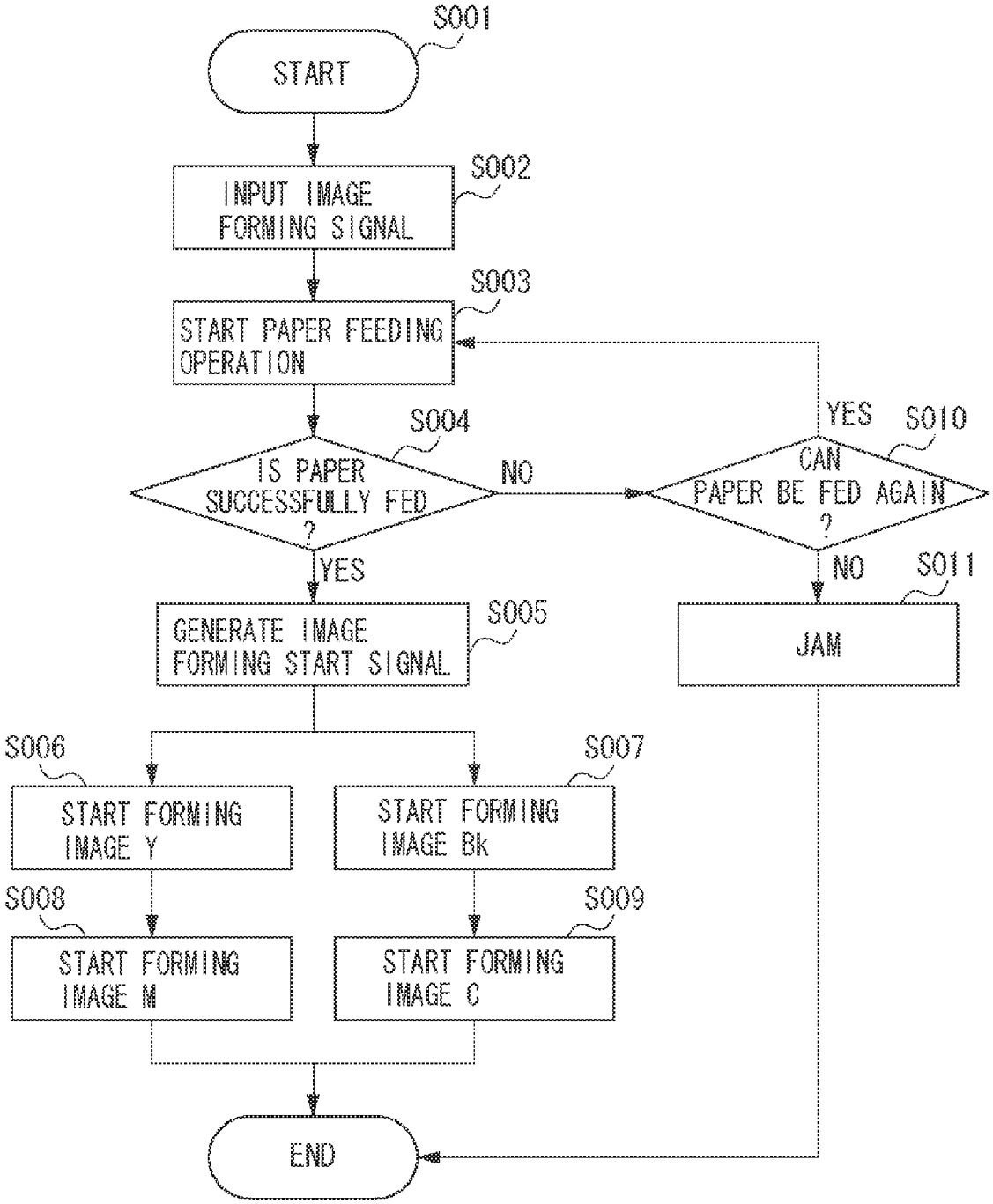
FIG. 7 is a flowchart illustrating an image formation according to the second exemplary embodiment of the present invention.

A relationship between the paper feeding operation and the image forming operation of the image forming apparatus 20 which has such a distance relationship is executed by a flow illustrated in FIG. 7. In step S001, an operational flow in FIG. 7 starts. In step S002, an image forming signal (print job) is input from the operation unit 1001 or the outside. In step S003, the paper feed units 3*a* or 3*b* starts the operation of feeding paper. In step S004, the control unit 1000 determines whether the paper is normally fed.

The control unit 1000 determines whether the recording material S conveyed in a direction indicated by an arrow F passes in a predetermined time interval using a detection sensor 106 provided on a main-body joining path 4, for example. If it is determined that the paper is normally fed (YES in step S004), then in step S005, the control unit 1000 generates an image forming start signal with the signal of the detection sensor 106 as a trigger. Then, first of all, the image forming units Y and Bk start forming images.

The toner image formed by the image forming unit Y is primarily transferred onto the second intermediate transfer belt 105*b* at the primary transfer unit 100Y and conveyed to the image forming unit M arranged downstream in the direction in which the second intermediate transfer belt 105*b* moves. Similarly, the toner image formed by the image forming unit Bk is primarily transferred onto the first intermediate transfer belt 105*a* at the primary transfer unit 100K and conveyed to the image forming unit C arranged downstream. As described above, the first process unit is similar in shape to the second process unit, two sides along which the image forming units are arranged are equal in length to each other and the primary transfer unit is arranged at the midpoint of each side. This aims to reduce color misregistration by making it easy to time each color and enhance a space efficiency of arrangement to efficiently use the common intermediate transfer belt.

In steps S006 and S007, the image forming units Y and Bk simultaneously start forming images. More specifically, image exposure start signals (a first and a second image-exposure start signal) are simultaneously transmitted to the photosensitive members 13Y and 13Bk respectively. This is because the distance from the contact portion (the primary transfer unit) between the photosensitive member 13Y and the second intermediate transfer belt 105*b* to the secondary transfer unit formed of the stretch rollers 101*b* and 103*a* is equal to the distance from the contact portion (the primary transfer unit) between the photosensitive member 13Bk and the first intermediate transfer belt 105*a* to the secondary transfer unit in the present exemplary embodiment. This is also because the movement speed of the first intermediate transfer belt 105*a* is equal to that of the second intermediate transfer belt 105*b*, so that the image formed by the image forming unit Y is superposed on the image formed by the image forming unit Bk at the secondary transfer unit.

In the present exemplary embodiment, the image forming units Y and Bk simultaneously start forming images. However, if the respective distances from the primary transfer unit to the secondary transfer unit are different from each other or the respective movement speeds of the intermediate transfer belts are different from each other, the image forming timings can be made different according to the distances or the speeds.

In steps S008 and S009, images also simultaneously arrive at the image forming units M and C. In other words, subsequently to the image formation of the image forming units Y and Bk, the image forming units M and C simultaneously start forming images and the images are processed in parallel. In the present exemplary embodiment, the distance from the contact portion (the primary transfer unit) between the photosensitive member 13C and the first intermediate transfer belt 105*a* to the secondary transfer unit formed of the stretch rollers 101*b* and 103*a* is equal to the distance from the contact portion (the primary transfer unit) between the photosensitive member 13M and the second intermediate transfer belt 105*b* to the secondary transfer unit. This is because the movement speed of the first intermediate transfer belt 105*a* is equal to that of the second intermediate transfer belt 105*b*, so that the image formed by the image forming unit C is superposed on the image formed by the image forming unit Bk at the secondary transfer unit.

In the present exemplary embodiment, the image forming units C and M simultaneously start forming images. However, if the respective distances from the primary transfer unit to the secondary transfer unit are different from each other or the respective movement speeds of the intermediate transfer belts are different from each other, the image forming timings can be made different according to the distances or the speeds.

The toner image formed by the image forming unit M is superposed on and primarily transferred onto the toner image formed by the image forming unit Y on the second intermediate transfer belt 105*b*. Further, the toner image formed by the image forming unit C is superposed on and primarily transferred onto the toner image formed by the image forming unit Bk on the first intermediate transfer belt 105*a*. The leading edges of both images meet at the nip portion formed of the stretch rollers 103*a* and 101*b* serving as the secondary transfer unit at the timing at which both the leading edges coincide with each other.

The secondary transfer unit applies electrostatic load bias to attractively move the toner images formed by the image forming units Bk and C on the first intermediate transfer belt 105*a* to the side of the second intermediate transfer belt 105*b*. In the present exemplary embodiment, since normal charge polarity of respective toners is negative, a predetermined positive-polarity voltage is applied to the stretch roller 101 and the stretch roller 102 is grounded, thereby enabling the secondary transfer.

The amount of toner to be transferred is large in the present exemplary embodiment, so that a voltage being higher than a voltage applied in the first exemplary embodiment is applied. As a result, a four different full-color toner image is formed on the second intermediate transfer belt 105*b*. The full-color toner image is collectively and electrostatically transferred (tertiary transfer) at the tertiary transfer unit located downstream onto the recording material S which is previously subjected to skew correction by a registration roller pair 5 and whose leading edge arrival timing is adjusted. The processes (for fixation and two-sided conveyance, for example) subsequent to the process at the tertiary transfer unit are similar to those described in the first exemplary embodiment, the description thereof is omitted.

Returning to FIG. 7, if it is determined that the paper is not normally fed (NO in step S004), then in step S010, a re-trial operation can be performed if a paper re-feeding operation can be performed (YES in step S010). This allows the reduction of a jam occurrence rate in the image forming apparatus to reduce down time. If is impossible to perform the re-trial operation (NO in step S010), in step S011, the control unit determines that a jam occurs.

Figure 3:
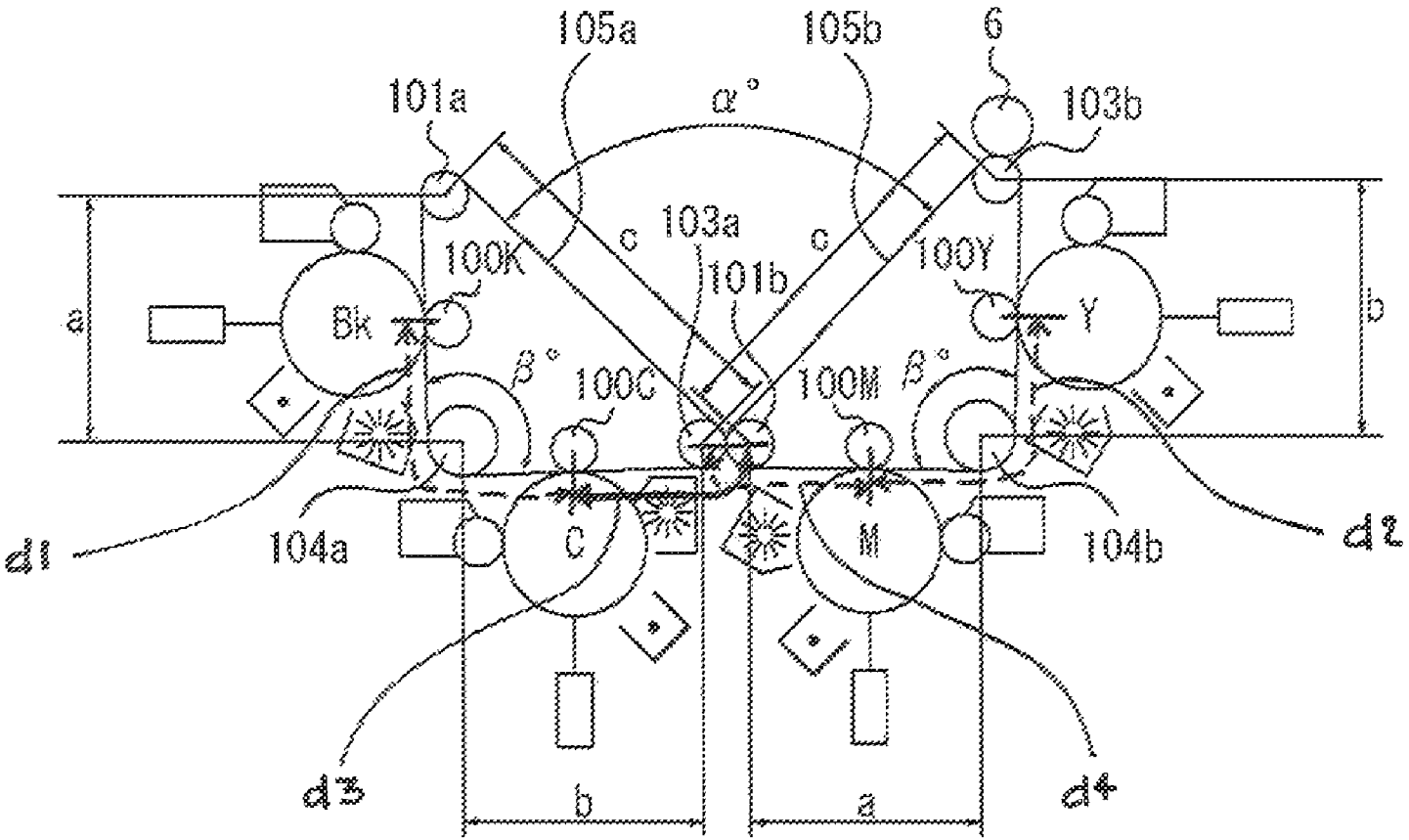
FIG. 3 is a cross sectional view illustrating a definition of dimensions of image forming units according to the present invention.

A geometric configuration of the first and the second process units is described below. FIG. 3 illustrates a configuration in which only an engine portion is extracted from the image forming apparatus. A distance between the belt drive rollers (104*a* and 104*b*) and the stretch rollers (101*a* and 101*b*) is defined as "a", a distance between the belt drive rollers (104*a* and 104*b*) and the stretch rollers (103*a* and 103*b*) is defined as "b", and a distance between the stretch rollers (101*a* and 101*b*) and the stretch rollers (103*a* and 103*b*) is defined as "c". An angle made by the side of the distance "a" and the side of the distance "b" is defined as "β" and a relative angle at which the first and the second process units are arranged is defined as "α". As already described above, in the image forming apparatus 20, the first process unit is made similar in shape to the second process unit to obtain the advantage of cost reduction due to the common use of components and units. As can be seen from the operation flow of FIG. 7, since the image forming processes are symmetrical with respect to the border of the secondary transfer unit (i.e., the nip portion formed of the stretch rollers 103*a* and 101*b*), an example of an isosceles stretch configuration with a=b is described.

The intermediate transfer belt in the present exemplary embodiment is in an isosceles right triangle configuration with an angle β of 90° and a=b. The reason is described with reference to FIGS. 4A and 4B.

Figure 4A:
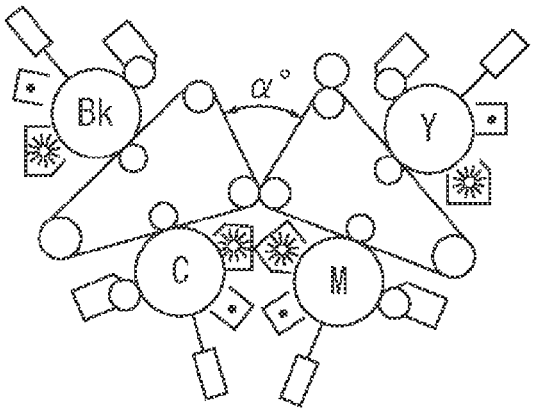
FIGS. 4A to 4C are cross sectional views illustrating layouts of the image forming units according to the present invention.

If β<90° as illustrated in FIG. 4A, the symmetrically arranged image forming units C and M tend to be close to each other, to avoid this, the angle α needs to be made acute. As a result, the symmetrically arranged image forming units Bk and Y, similarly to the image forming units C and M, become level with or above the tertiary transfer unit, so that it is required to bend the conveyance path of the recording material S.

Figure 4B:
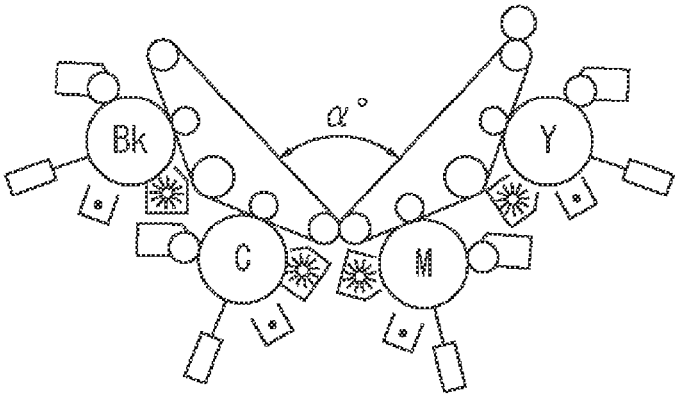
Figure 4C:
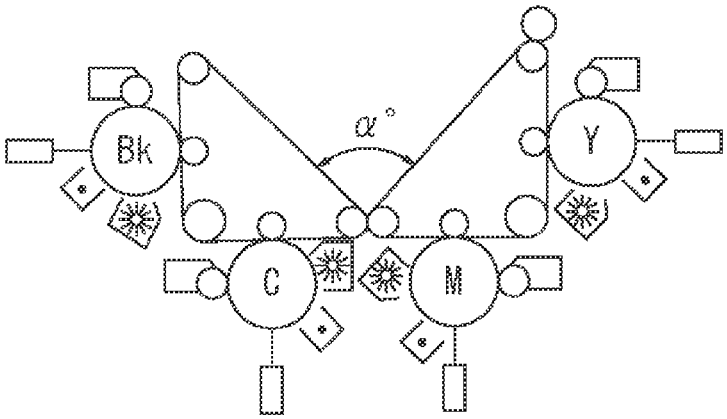

On the other hand, if β>90° as illustrated in FIG. 4B, the above problem in the case where β<90° does not occur, however, the intermediate transfer belt tends to geometrically increase in a stretch distance C. As a result, the distance of movement of an image is increased to decrease the effect obtained from the present invention. From the above consideration, although the configuration of FIGS. 4A and 4B is basically acceptable, the configuration in the case where β=90° illustrated in FIG. 4C is the most efficient with consideration for an overall balance.

The drive configuration of the first and the second intermediate transfer belts 105*a* and 105*b* is described below. The two intermediate transfer belts used in common are arranged symmetrically with each other, so that at least any one of the stretch rollers 101 and 103 serves as a transfer roller. For this reason, the roller 104 which stretches the belt at a position where the angle β is formed is selected as a belt drive roller. In the image forming apparatus using an intermediate transfer tandem method, registration for each color, i.e., color misregistration needs to be considered. Distance relationships among the image forming processes which are performed in parallel from the image forming unit Bk to the image forming unit C and from the image forming unit Y to the image forming unit M and the conveyance processes from the image forming unit C to the secondary transfer unit and from the image forming unit M to the secondary transfer unit are required to easily coincide with each other. Therefore, the isosceles stretch configuration with a=b is used and the primary transfer unit for each color is arranged at the midpoint of the isosceles side.

Further, the arrival time as well as the above distance relationships needs to eventually coincide with each other to improve an accuracy in registration for each color. This requires the consideration of rotation unevenness of the belt drive rollers 104*a* and 104*b* which causes a relative difference in peripheral speed between the two intermediate transfer belts. Therefore, the image forming apparatus uses two methods described below.

In a first method, the primary transfer distances d1 and d2 from the image forming unit Bk to the image forming unit C and from the image forming unit Y to the image forming unit M and the distances d3 and d4 from the image forming unit C to the secondary transfer unit and from the image forming unit M to the secondary transfer unit are set to an integral multiple of a perimeter of the belt drive roller. As a result, a variation in speed caused by the rotation unevenness of the belt drive rollers 104*a* and 104*b* coincides with each other at the primary and the secondary transfer unit for each color not to cause a relative registration. In a second method, drive gears of the belt drive rollers 104*a* and 104*b* are matched in phase with each other.

Figure 5:
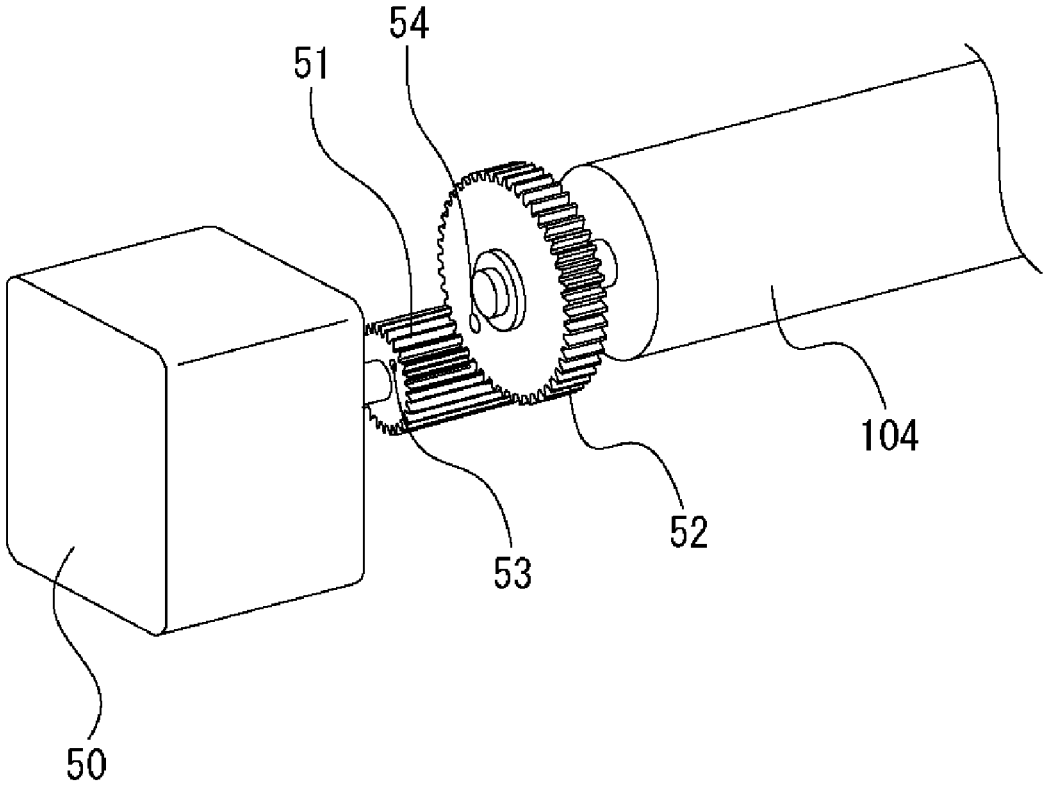
FIG. 5 is a perspective view of a drive configuration of a belt drive roller according to the present invention.

FIG. 5 is a perspective view of the drive configuration of the belt drive rollers 104*a* and 104*b*. Drive is transmitted to a belt drive gear 52 from a motor gear 51 provided on a shaft of a belt drive motor 50 to drive the belt drive roller 104. The motor gear 51 and the belt drive gear 52 are resin or sintered molding gears and provided with phase control marks 53 and 54. It is generally known that assembly is performed with the phase control marks 53 and 54 matched to each other to cause the engagement profile of a gear between a plurality of intermediate transfer belt units to coincide with each other.

In the image forming apparatus, however, the first and the second intermediate transfer belt 105*a* and 105*b* are conveyed in the opposite direction to each other. For this reason, not only the drive gears of the belt drive rollers 104*a* and 104*b* are matched in phase with each other by the gear marks 53 and 54, but also the surface of the gear mark is attached upside down. Accordingly, the engagement profile of the gear can be caused to accurately coincide with each other between the belt drive rollers 104*a* and 104*b*. FIG. 5 illustrates an example of the simplest drive configuration. However, the number of drive motors and the number of steps for deceleration are not limited to the above configuration.

In the image forming apparatus described above, the number of colors is taken as four and the colors Y, M, C, and Bk are arranged in this sequence. However, the number of colors and the arrangement sequence of the colors are not limited to the above configuration.

As described above, according to the present invention, even if a plurality of intermediate transfer members is provided, a transfer stability can be improved by collectively transferring a full-color toner image onto the recording material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-136364 filed Jun. 5, 2009, which is hereby incorporated by reference herein in its entirety.

What is claimed is:

1. An image forming apparatus comprising:

a first intermediate transfer belt configured to carry a toner image;

a first primary transfer unit configured to transfer a toner image from a first image forming unit configured to form a toner image to the first intermediate transfer belt;

a second primary transfer unit arranged more downstream than the first primary transfer unit in a moving direction of the first intermediate transfer belt and configured to transfer a toner image from a second image forming unit configured to form a toner image to the first intermediate transfer belt;

a second intermediate transfer belt configured to carry a toner image;

a third primary transfer unit configured to transfer a toner image from a third image forming unit configured to form a toner image to the second intermediate transfer belt;

a fourth primary transfer unit arranged more downstream than the third primary transfer unit in a moving direction of the second intermediate transfer belt and configured to transfer a toner image from a fourth image forming unit configured to form a toner image to the second intermediate transfer belt;

a secondary transfer unit configured to transfer the toner image from the first intermediate transfer belt to the second intermediate transfer belt such that the toner image formed on the first intermediate transfer belt is superposed on the toner image formed on the second intermediate transfer belt;

a tertiary transfer unit configured to collectively transfer toner images on the second intermediate transfer belt that has passed the secondary transfer unit from the second intermediate transfer belt onto a recording medium;

a first drive roller configured to drive the first intermediate transfer belt, a perimeter of the first drive roller being an integral division of a distance from the first primary transfer unit to the second primary transfer unit in a moving direction of the first intermediate transfer belt and an integral division of a distance from the second primary transfer unit to the secondary transfer unit in the moving direction of the first intermediate transfer belt;

a second drive roller configured to drive the second intermediate transfer belt, a perimeter of the second drive roller being an integral division of a distance from the third primary transfer unit to the fourth primary transfer unit in a moving direction of the second intermediate transfer belt and an integral division of a distance from the fourth primary transfer unit to the secondary transfer unit in the moving direction of the second intermediate transfer belt and equal to the perimeter of the first drive roller;

a first stretch roller configured to stretch the first intermediate transfer belt with the first drive roller, and a second stretch roller configured to form the secondary transfer unit; and a third stretch roller configured to stretch the second intermediate transfer belt with the second drive roller and form the tertiary transfer unit, and a fourth stretch roller configured to form the secondary transfer unit, wherein, on a plane perpendicular to a rotation axis of the first drive roller, the first primary transfer unit is arranged at a position opposed to a first side of the first intermediate transfer belt stretched by the first stretch roller and the first drive roller, and the second primary transfer unit is arranged at a position opposed to a second side of the first intermediate transfer belt stretched by the first drive roller and the second stretch roller, and wherein, on a plane perpendicular to a rotation axis of the second drive roller, the third primary transfer unit is arranged at a position opposed to a third side of the second intermediate transfer belt stretched by the third stretch roller and the second drive roller, and the fourth primary transfer unit is arranged at a position opposed to a fourth side of the second intermediate transfer belt stretched by the second drive roller and the fourth stretch roller.

2. The image forming apparatus according to claim 1, wherein a length of the first side is almost the same as a length of the second side on the plane perpendicular to the rotation axis of the first drive roller, and a length of the third side is almost the same as a length of the fourth side on the plane perpendicular to the rotation axis of the second drive roller.

3. The image forming apparatus according to claim 2, wherein an angle formed by the first side and the second side is approximately 90° on the plane perpendicular to the rotation axis of the first drive roller, and an angle formed by the third side and the fourth side is approximately 90° on the plane perpendicular to the rotation axis of the second drive roller.

4. The image forming apparatus according to claim 3, wherein the first primary transfer unit is arranged near a midpoint of the first side, the second primary transfer unit is arranged near a midpoint of the second side, the third primary transfer unit is arranged near a midpoint of the third side, and the fourth primary transfer unit is arranged near a midpoint of the fourth side.

5. The image forming apparatus according to claim 4, wherein the rotation axis of the first drive roller is substantially parallel to the rotation axis of the second drive roller, and wherein, on a surface perpendicular to the rotation axis of the first drive roller and the rotation axis of the second drive roller, the first intermediate transfer belt and the second intermediate transfer belt are arranged in such a way that an angle formed by a fifth side of the first intermediate transfer belt stretched by the second stretch roller and the first stretch roller and a sixth side of the second intermediate transfer belt stretched by the fourth stretch roller and the third stretch roller is approximately 90°.

* * * * *